US005391086A

United States Patent [19]

Woller et al.

[11] Patent Number: 5,391,086

[45] Date of Patent: Feb. 21, 1995

[54] AUTOMOTIVE DOOR-TO-BODY ELECTRICAL CONNECTOR

[75] Inventors: Josef Woller, Griesheim; Peter H. Hilser, Nauheim, both of Germany

[73] Assignee: The Whitaker Corporation, Wilmington, Del.

[21] Appl. No.: 114,536

[22] Filed: Aug. 31, 1993

[30] Foreign Application Priority Data

Sep. 11, 1992 [GB] United Kingdom ..... 9219328

[51] Int. Cl.[6] ..... H01R 13/629

[52] U.S. Cl. ..... 439/157; 439/310; 439/556; 439/557; 439/372

[58] Field of Search ..... 439/34, 157, 310, 372, 439/476, 544, 559, 567, 923, 373, 552, 555–557, 562

[56] References Cited

U.S. PATENT DOCUMENTS 3,753,212 8/1973 Yamada et al. ..... 439/557 X 4,684,190 8/1987 Clark et al. ..... 439/552 X

FOREIGN PATENT DOCUMENTS 0273999 7/1988 European Pat. Off. ..... 439/157

*Primary Examiner*—Steven C. Bishop

*Attorney, Agent, or Firm*—Eric J. Groez

[57] ABSTRACT

An electrical connector assembly is comprised of an insulating housing for fixed mounting within an automotive body behind panel walls. A mating connector has a housing portion and a peripheral shroud. The shroud has integral latches which retain the shroud and housing together, and the shroud includes latches which retain the shroud to the panel. Actuating lugs are positioned on the front of the housing portion and are profiled for receipt within a groove on a camming slide. The latches hold the shroud and housing together during the actuation of the lugs and the camming slide. When the latches are locked behind the panel wall, the shroud inner surface contacts the panel wall, whereby the latches break free of the corresponding lugs on the housing. Continued actuation of the U-shaped camming slide moves the connector housing into fully locked position, leaving the shroud positioned against the wall.

20 Claims, 12 Drawing Sheets

AUTOMOTIVE DOOR-TO-BODY ELECTRICAL CONNECTOR

BACKGROUND OF THE INVENTION

1. Field of the Invention

The subject invention relates to an electrical connector assembly including complementary actuating members positioned on first and second electrical connectors for making the electrical engagement between the two connectors.

2. Description of the Prior Art

It is quite common in automotive applications to provide electrical connectors within the pillar posts or in the frame section where one connector member is fixed within the frame, and a second connector member carries electrical cable into the door, to operate electric devices from the driver's or passenger's door. Such electronics would include electric window openers, electric mirrors, electric door locks, and the like. The cable which extends into the door must be weather protected as this cable is exposed to the exterior elements upon opening the door, as this cable is the electrical "hinge" between the car body and the door. It is typical then that the connector which provides cabling into the door carries a corrugated sealing member or boot in surrounding relationship to the cable and extends into an opening in the door.

In previous designs of such automotive connectors, the connector which extends into the door is separated from the sealing boot, by pulling the sealing boot rearwardly, and the connector is first positioned in place through an opening in the car body and into a first position aligning the two mating connectors, but not providing full electrical connection between the two connectors. The insulating boot is then moved relative to the first connector and is snapped into engagement with the panel opening into the car body. Subsequently an actuating member between the two connectors is activated bringing the two connector halves into a fully connected position. Given the small distance in which to work between the end of the door and the car body, and due to the stiffness of the cable extending into the door and the number of cables required, this has heretofore been a difficult assembly process. A previously known actuation system is shown in EP application 0 273 999.

SUMMARY OF THE INVENTION

It is therefore an object of the invention to provide a connector assembly offering an easier assembly method than the previous mentioned connector system.

It is a further object of the invention to provide a connector assembly whereby the actuation provided between the connector housings also moves the sealing boot into sealing engagement with the car body.

The objects of the invention were accomplished by providing an electrical connector assembly comprising first and second connectors, the first and second connectors having complementary actuating members for drawing the two connectors together, the second connector being insertable through a panel opening into engagement with the first connector. The assembly is characterized in that the housing has a peripherally extending shroud remaining exterior to the opening adjacent to the panel, the actuating members causing the shroud and said housing to move into a final abutting position against the panel.

Preferably, the second connector is comprised of a housing member and a peripherally extending shroud, the housing member carrying a plurality of electrical terminals for engagement with the mating contacts of the first connector. The housing member is profiled for receipt within the opening and has complementary actuating members adjacent to the front of the housing for interaction with the first connector, while the peripherally extending shroud remains exterior to the opening adjacent to the panel. The housing member and the shroud member have first cooperating latching mechanisms retaining them together, and the shroud member has second latches profiled for engagement with the panel opening to retain the shroud of the panel. The latches are profiled such that the retaining forces of the first latches retain the housing and shroud together during the activation of the complementary actuating members, until the second latch member is latched to the panel, whereby continued activation of the actuating members causes the first latches to release the housing from the shroud moving the second connector housing independently into connection with the first connector.

DETAILED DESCRIPTION OF THE PREFERRED EMBODIMENT

Figure 1:
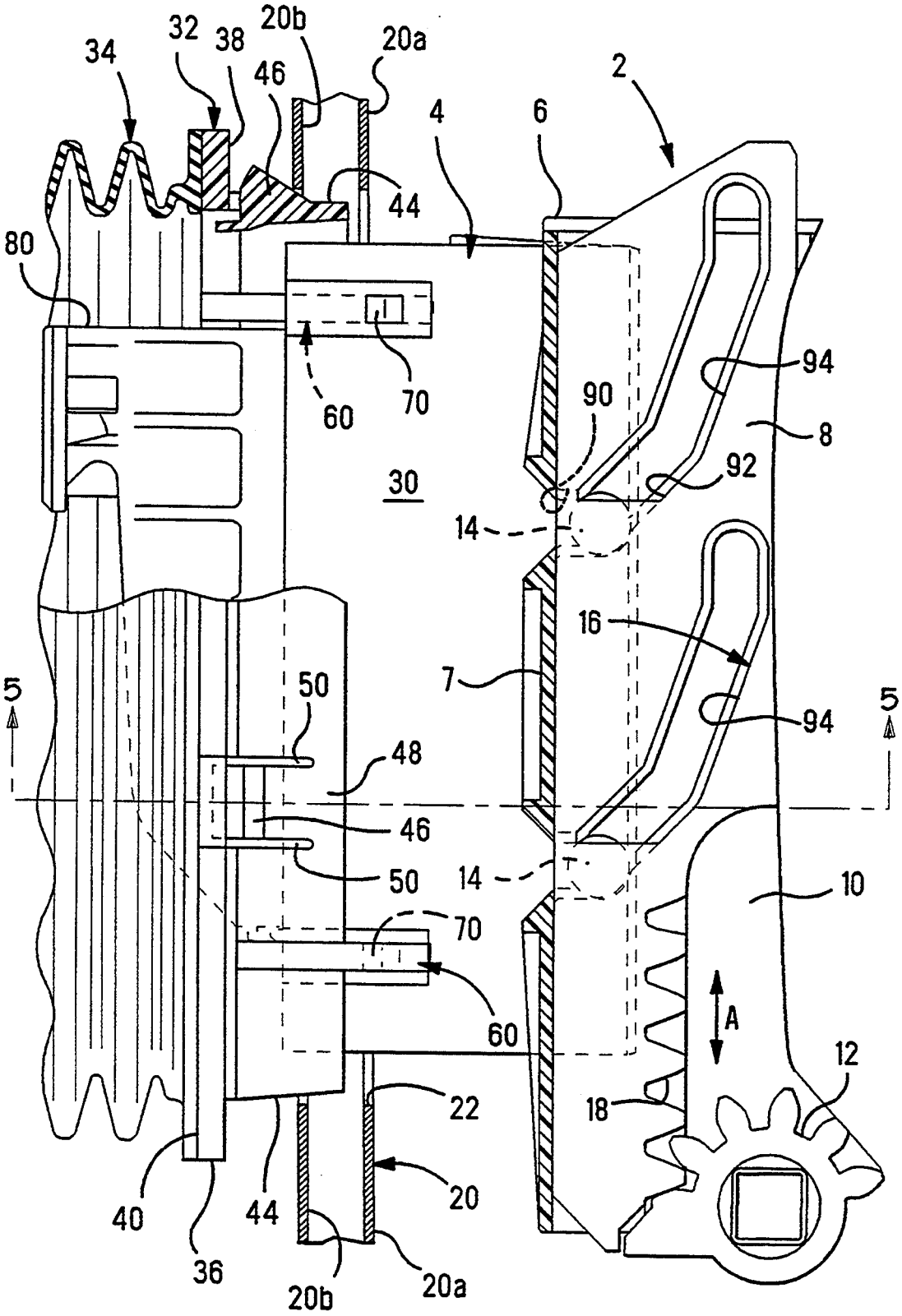
FIG. 1 is a side view in partial section showing the first and second connector members of the assembly poised for electrical engagement.

With reference now to FIG. 1, an electrical connector system is shown comprising a fixed connector portion 2 and a moveable connector portion 4 mateable with the connector portion 2. The connector pair comprised of electrical connectors 2 and 4 are generally of the type shown in European Patent Publication 0 273 999, carrying a camming slide and locking lug arrangement. More particularly the electrical connector 2 includes a fixed housing portion 6 and a slidable actuator portion 8 which carries an integral rack portion 10 operable by way of a pinion at 12. Electrical connector 4 includes complementary locking lugs 14 which are co-operable with camming tracks 16 on the connector 2 for moving the electrical connectors 2 and 4 in an axial mating direction relative to each other.

In the preferred embodiment of the invention, the camming slide 8 is moveable in the direction A which is parallel to the major axis of the camming slide under influence of the pinion 12 and the integral rack teeth 18. As the rack member 8 is moveable along the transverse axis A, yet is fixed in the axial direction movement of the rack member 8 in the direction A, once the camming lugs 14, located on the sidewalls of the housing 4, are located within the camming tracks 16, actuation of the camming slide 8 moves the connector housings 2 and 4 into mated engagement. In the preferred embodiment of the invention, electrical connector 2 is located on the back side of a mounting wall shown best as 20, comprised of two parallel wall sections 20A and 20B where the wall sections 20A and 20B form an opening at 22 for the receipt of the connector assembly 4.

In the preferred embodiment of the invention, the connector assembly 4 is comprised of an electrical connector housing portion 30, an insulating shroud portion 32 and a sealing boot shown generally at 34 which in the preferred embodiment is formed integrally with a flange portion 32.

As shown in FIG. 1, the flange member 32 includes a flange ring shown generally at 36, and in the preferred embodiment is rectangular in nature including a front surface 38 which can be abutted against the front surface of the panel 20B, and further includes a rear surface shown generally at 40 for carrying the boot member 34 therewith. The shroud member 32 further includes a rectangular peripheral wall at 44 which partially surrounds the electrical connector housing 30 as shown in FIG. 1. The shroud member 32 includes three latching members 46 which are integrally moulded with the shroud member 32 being pivotable about a root portion at 48 and being free at side sections 50. In the preferred embodiment one latch portion 46 is integrally formed with an upper side wall 44 whereas as shown best in FIG. 1 and 5 two latch members 46 extend integrally with opposite side walls 48. Each of the latching elements 46 includes a camming surface at 52 and a locking surface at 54, as best shown in FIG. 5.

The shroud member 32 further includes four latching elements shown generally at 60 in FIG. 1 extending integrally with the side walls 48 of the shroud member 32. As shown best in FIG. 5, the members 60 include cantilever beam portions at 62 which are profiled to be received within the opening 22 of the panel 20. The latch members 60 further include latching projections at 64 including latching surfaces at 66. These latching projections 64 are profiled to engage a complementary surface 70 of a projection 72 located on the side wall 74 of the housing 30.

Figure 5:
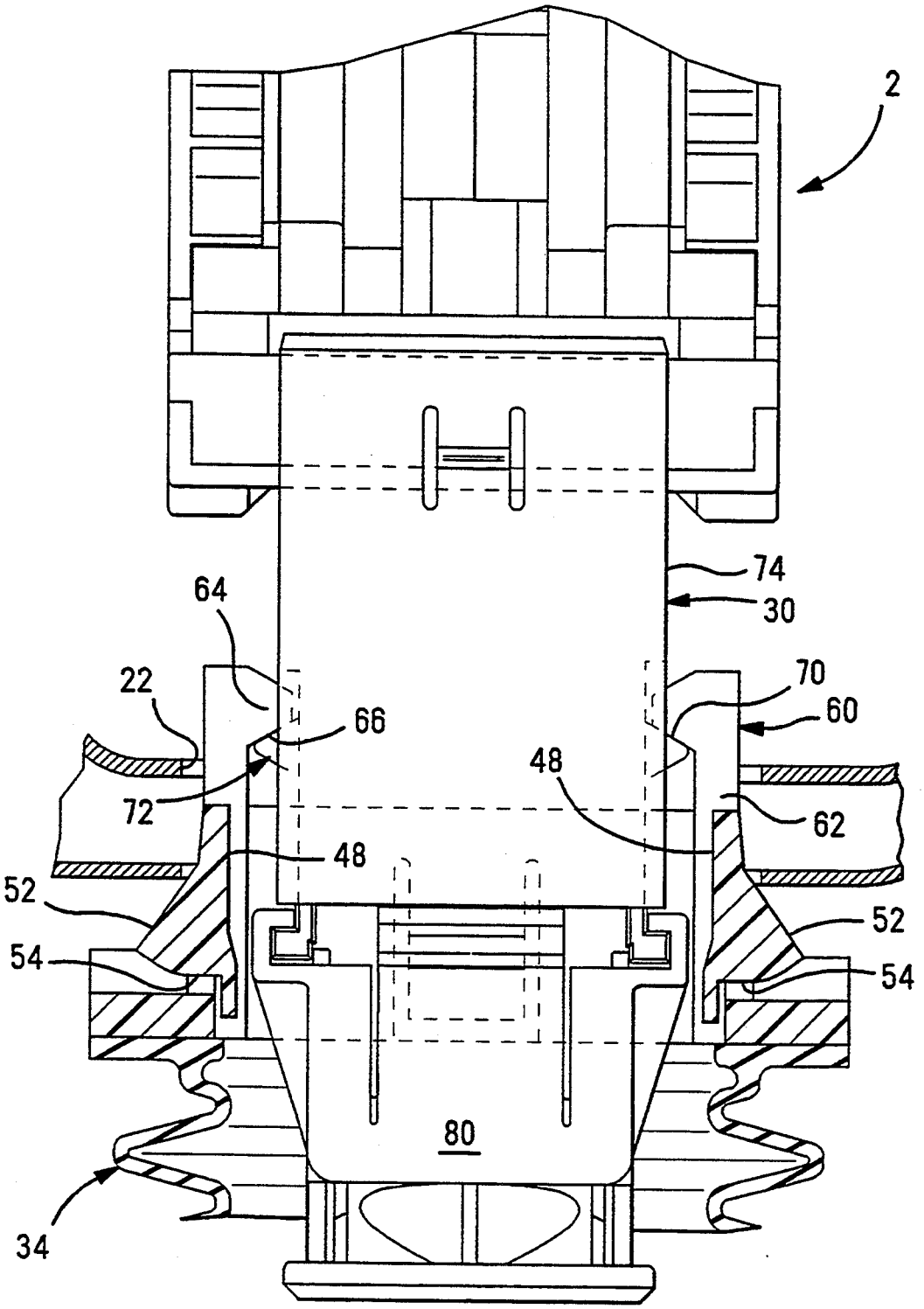
FIG. 5 shows a cross-sectional view through lines 5—5 of FIG. 1.

As best shown in FIGS. 1 and 5, the electrical connector body 30 is terminated to a plurality of insulated conductors (not shown) which extend out of the lead-out section 80 (FIG. 1) of the connector body portion 30, and through a corrugated sealing tube connected to the boot 34. These wires would be contained in a strain relief manner to the housing body portion 30 by way of conventional means such as a tie-wrap around the member 80. It should be appreciated that the electrical connector housing 30 includes a plurality of electrical terminals electrically terminated to insulated conductors which extend through the lead-out section 80. The electrical terminals positioned in the connector housing 30 are electrically connectable with a plurality of electrical terminals in the housing portion 6 (FIG. 1) for making electrical interconnection between the two connection members 2,4.

As presented, the electrical housing 30 is snapped to the shroud member 32 as shown in FIGS. 1 and 5 which maintains the connector housing 30 and the insulating boot portion 34 together. As shown in FIG. 1, the connector portion 30 can be positioned with the integral camming lugs 14 into the alignment slots 90 of the camming slots 16 for precise registration between the connector member 30 and the connector member 6. When in this position, the pinion can be rotated which moves the camming lugs 14 along the camming slot portion 92 bringing the connector housing portion 30 and shroud portion 32 inwardly towards the connector member 2.

Figure 2:
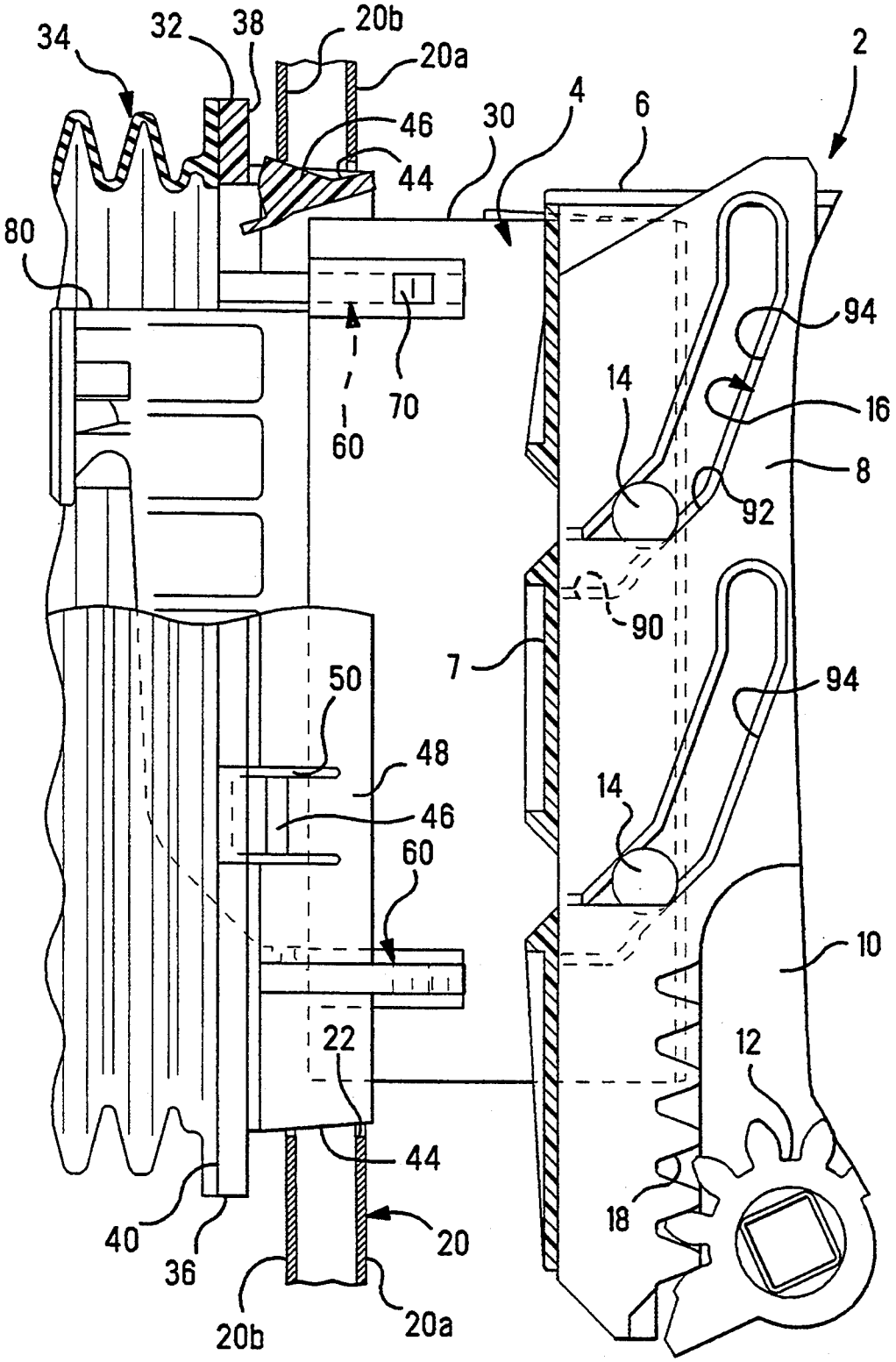
FIG. 2 shows the beginning actuation between the two connector halves showing the latches on the peripheral shroud member beginning to deflect.
Figure 3:
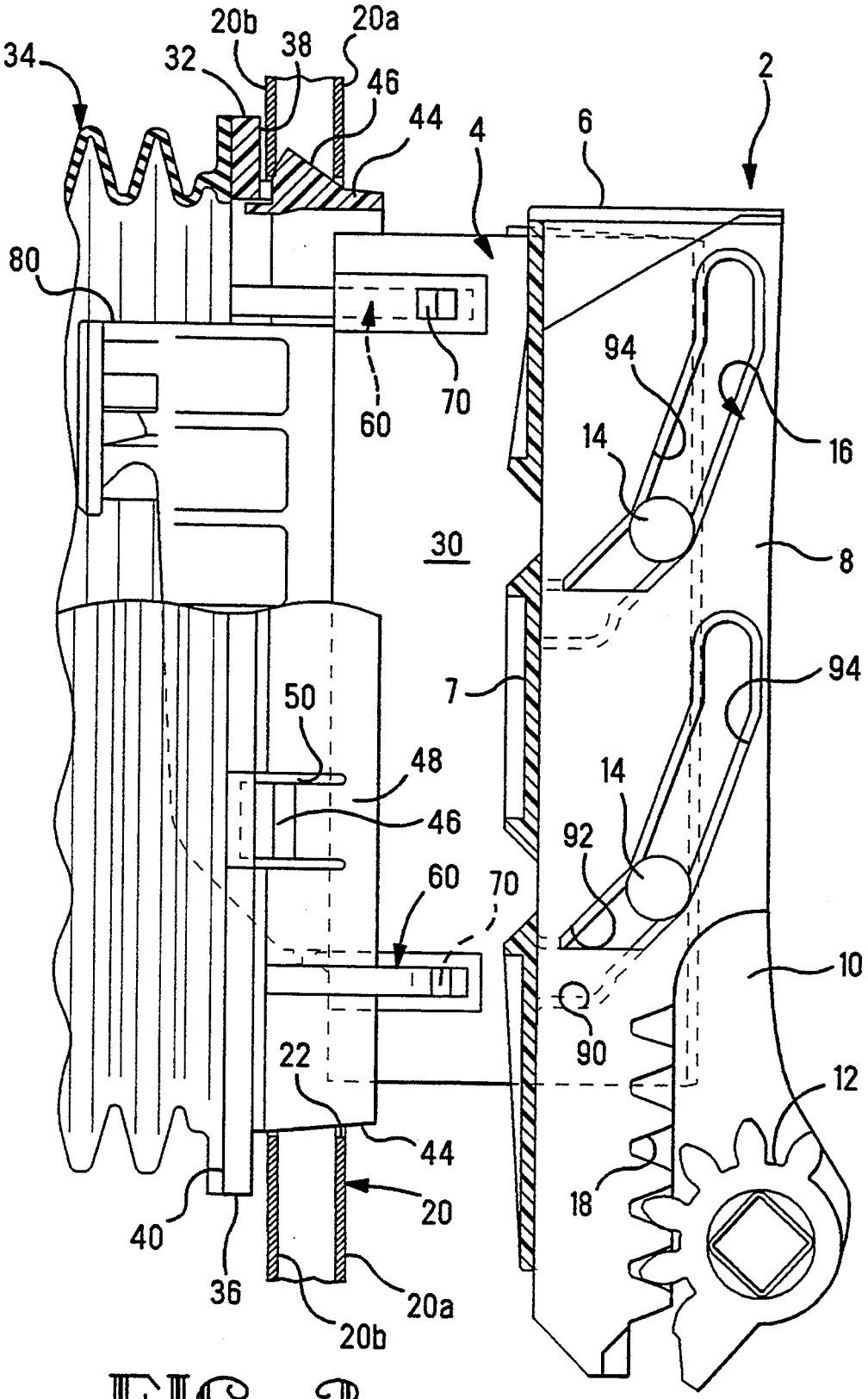
FIG. 3 shows the peripheral shroud member fully positioned against the panel opening.
Figure 4:
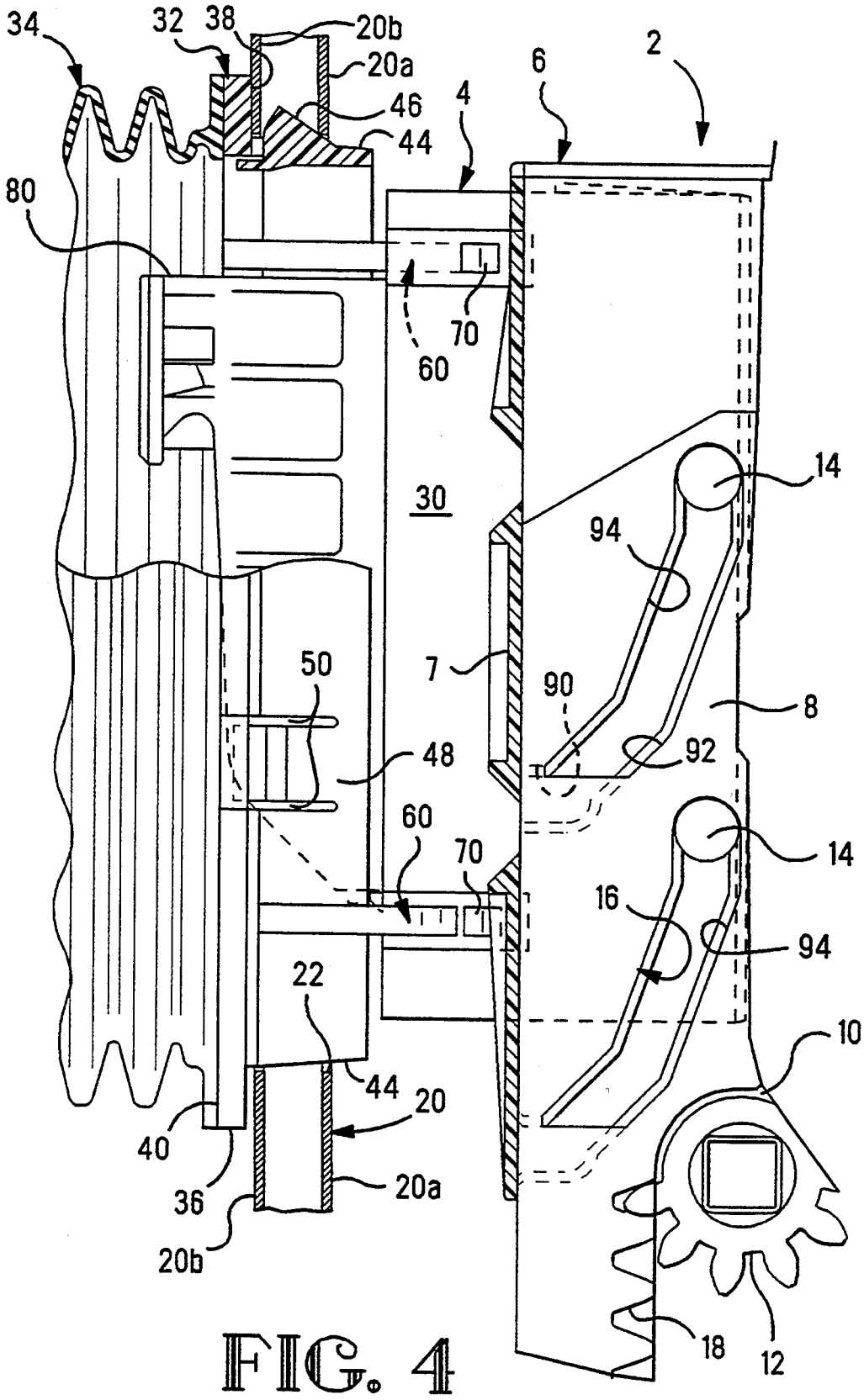
FIG. 4 shows the connector assembly fully inserted.
Figure 6:
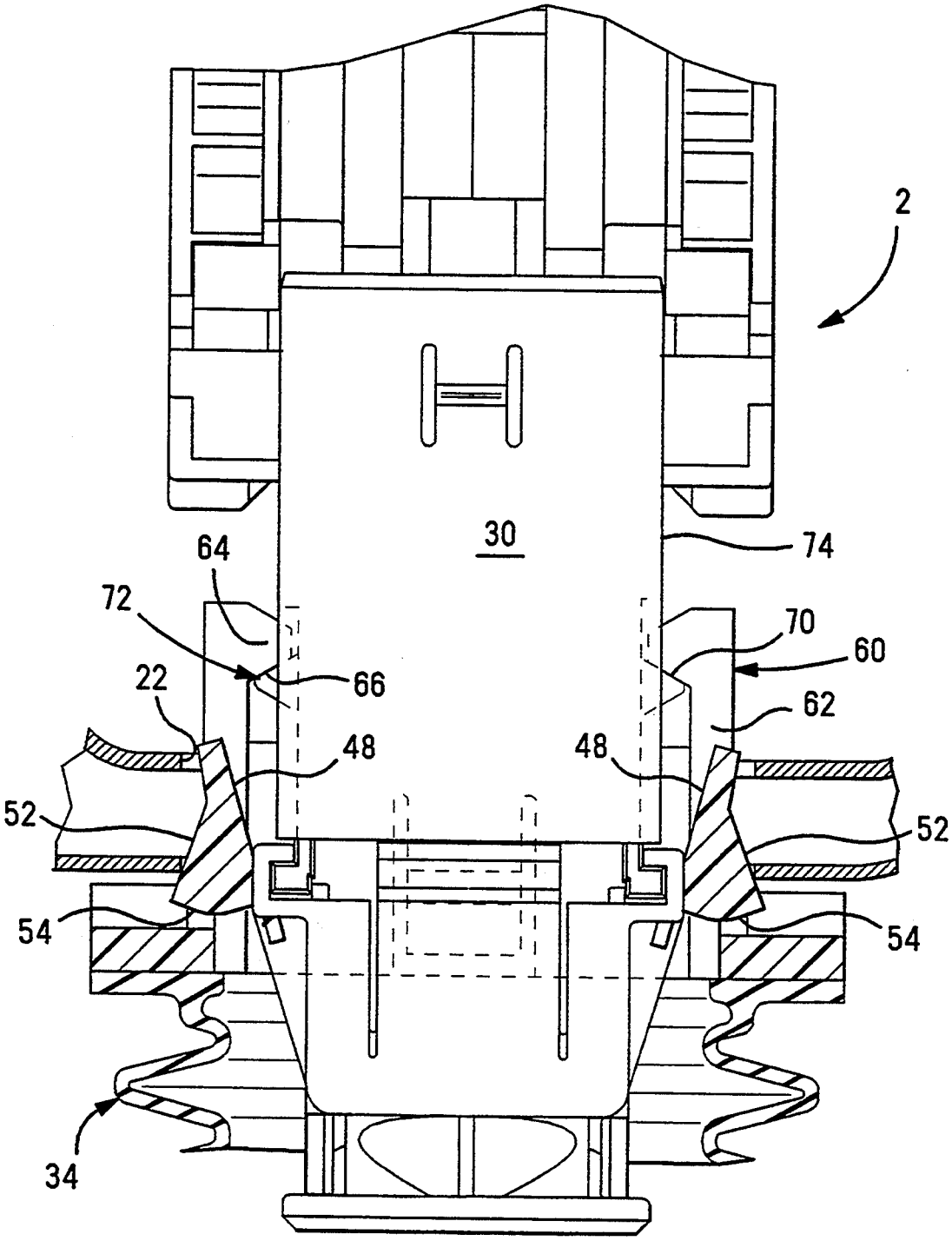
FIG. 6 shows a cross-sectional view similar to that of FIG. 5 although in the position coinciding to that of FIG. 2.
Figure 7:
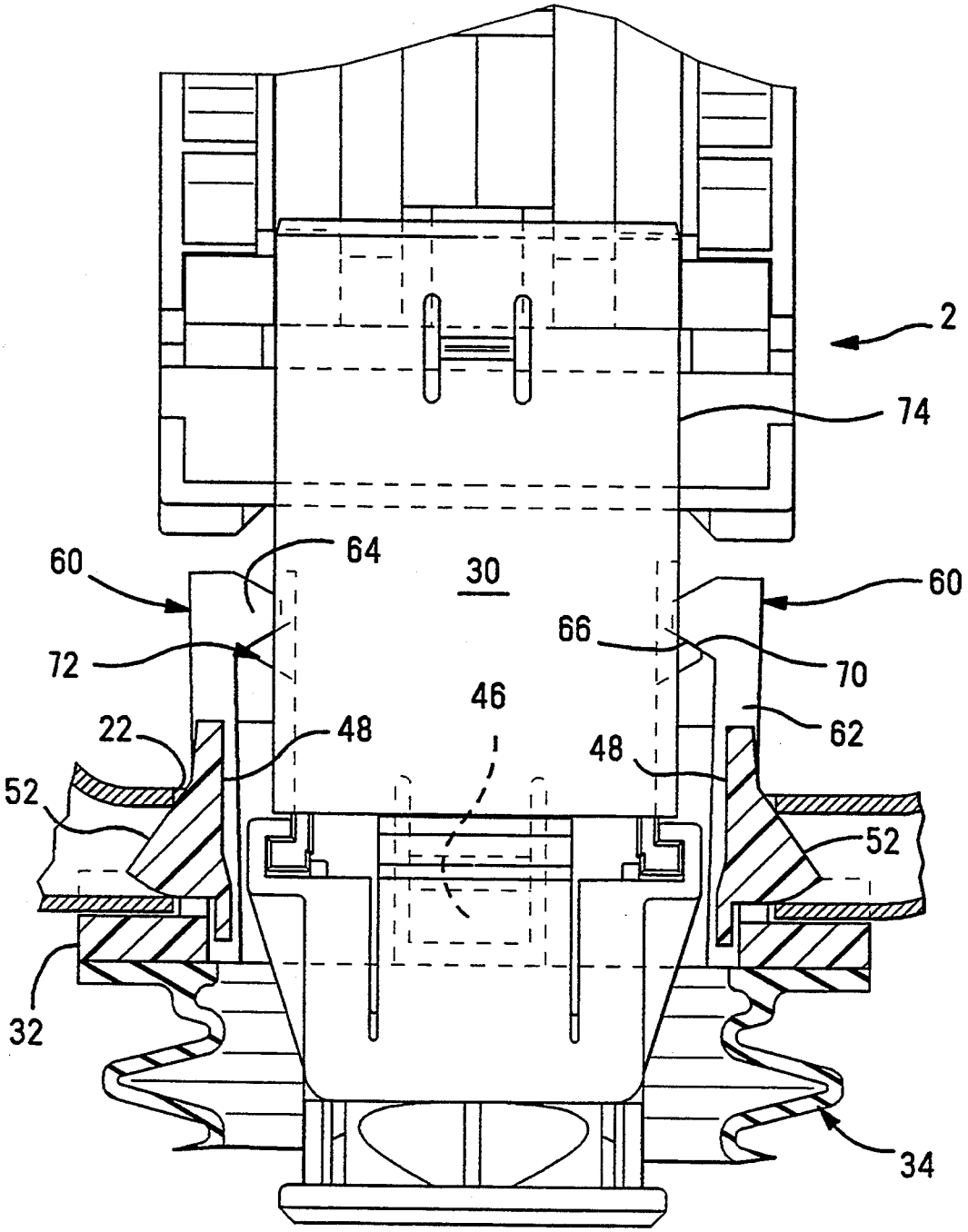
FIG. 7 is a cross-sectional view similar to that of FIG. 1 coinciding with the position shown in FIG. 3.
Figure 8:
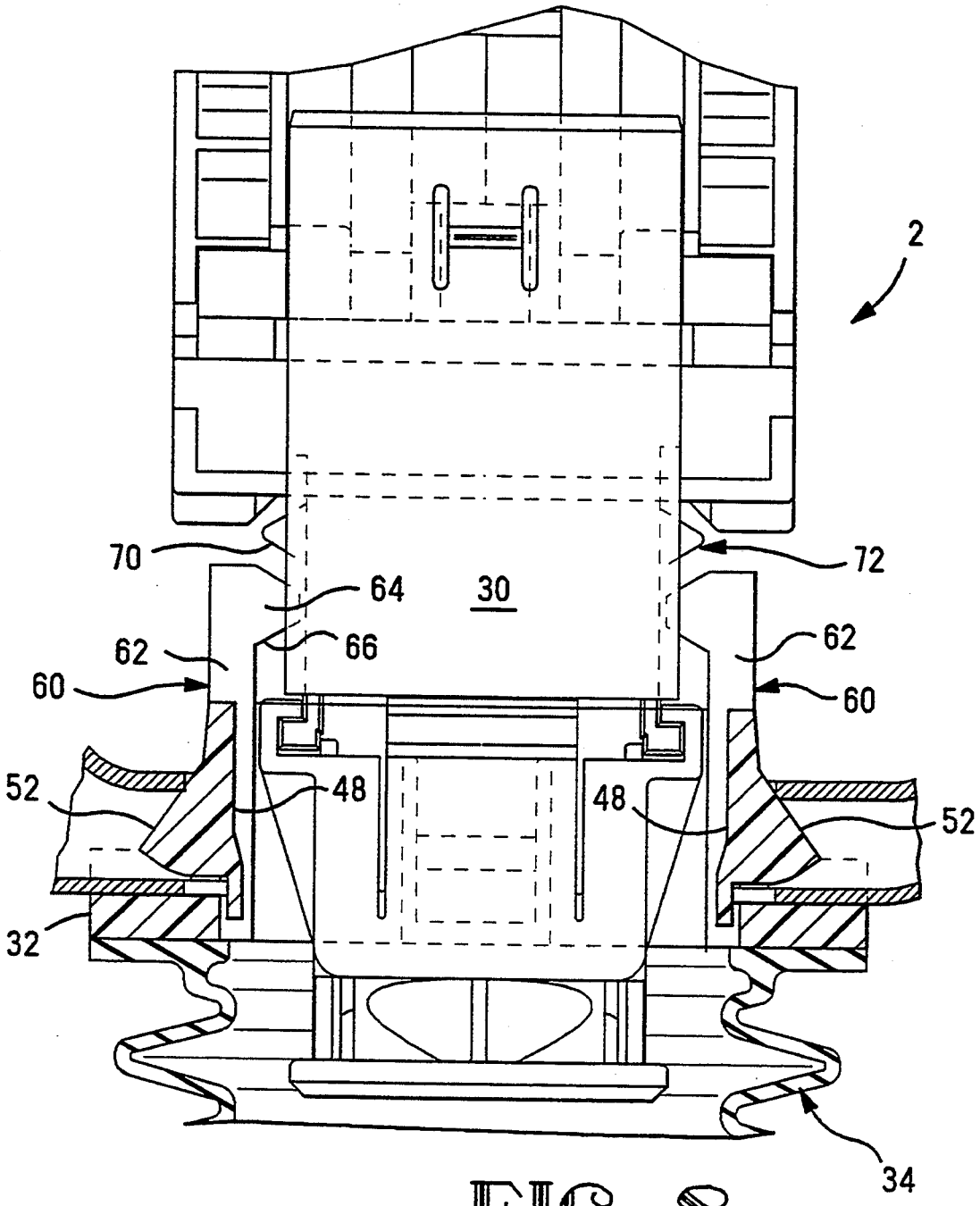
FIG. 8 is a cross-sectional view similar to that of FIG. 5 showing the position coinciding with that of FIG. 4.
Figure 12:
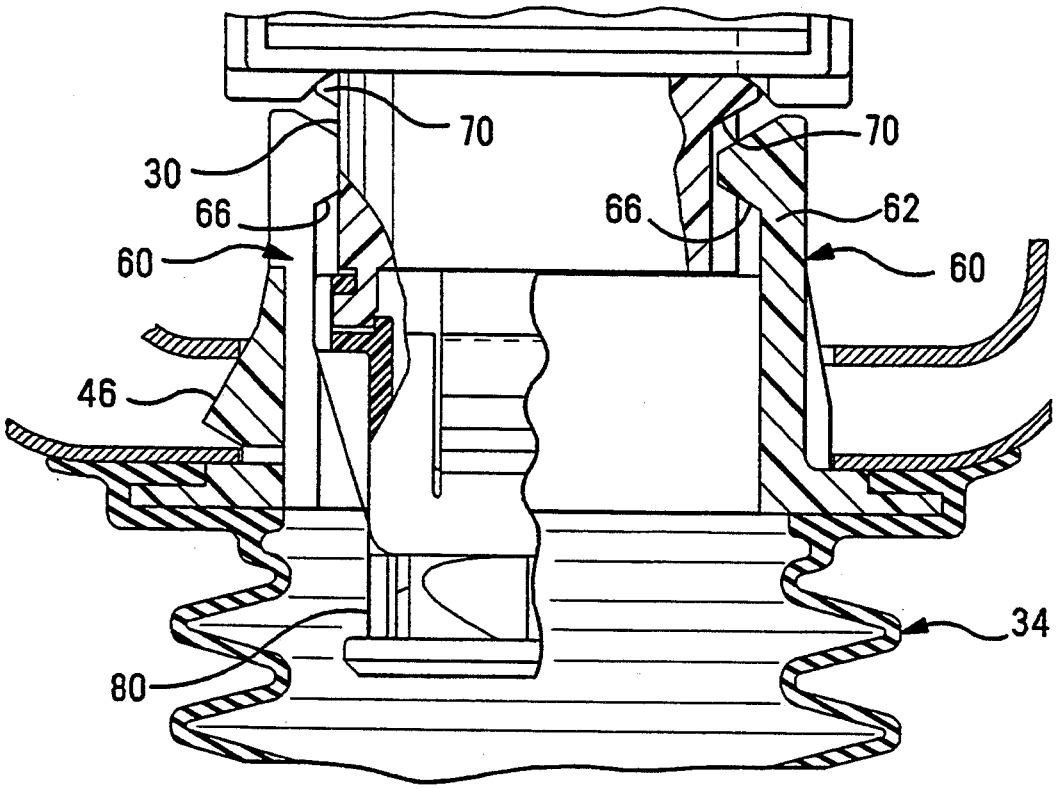
FIG. 12 is a view similar to that of FIG. 11 showing the connector housing breaking free of the latches which are integral with the shroud member.

It should be understood that the resistance to overcome the latch member 46 within the double wall backpanel 20 is less than the resistance to overcome the latch arms 60 with their complementary latch members 72. Thus as shown in FIGS. 2 and 6, as the camming lugs 14 progress into the camming slot portion 92 the latch members 46 begin to resile against the walled portion 20*b* whereas the latching arms 62 remain fixed to the connector housing portion 30, as shown in FIGS. 2 or 6 thereby pulling the flange portion 32 inwardly. Continued movement of the pinion portion 12 moves the latch element 46 into locked engagement as shown in FIGS. 3 and 7. Further rotation of the pinion portion 12 causes the lugs 14 to cooperate with the slot portion 94, and pulls the flange portion 32 against the wall portion 20*b*, causing the connector portion 30 to break away from the associated latching arms 60, as shown in FIGS. 8 and 12, to move the connector housing portion 30 into mating relation with the connector housing portion 6. As shown in FIGS. 4 and 8, the shroud portion 32 is fully seated against the panel portion 20 and the connector housing portion 30 is in full electrical connection with the housing portion 6.

It should be appreciated that the camming slot portion 92 is steep relative to the mating face 7 of the housing portion 6. This allows quick axial takeup of the housing 30 with small movement of the U-shaped slide 2. The slot portion 94 however, is relatively shallow as compared to the mating face 7 of housing 6, this providing for increased mechanical advantage to break the latches 60 free from the associated locking lugs 70 on the housing 30, as well as to overcome the insertion force between the two connectors 2,4.

Figure 9:
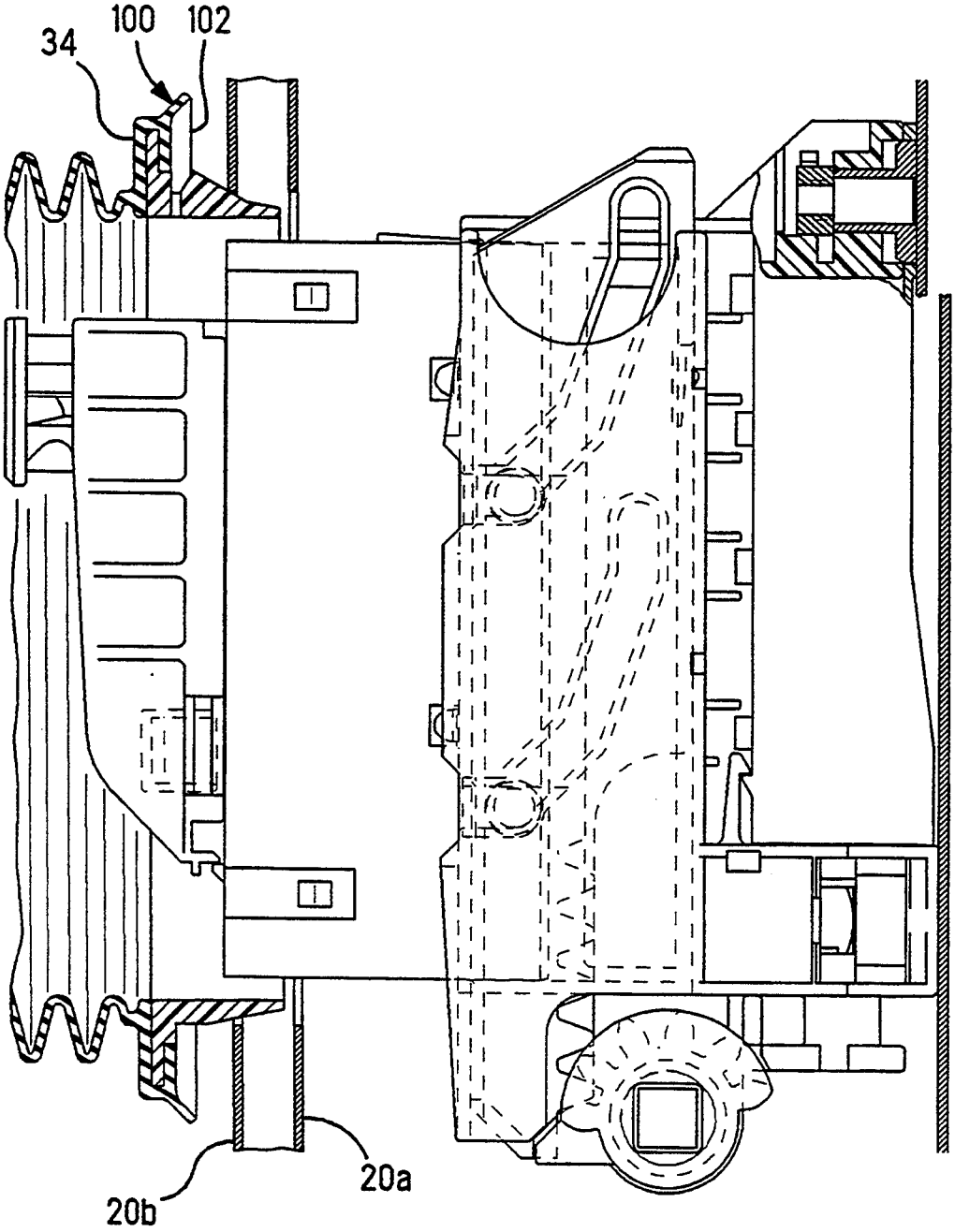
FIG. 9 shows an alternate embodiment similar to that of FIG. 1 showing a peripheral seal integrally connected to the boot member.
Figure 10:
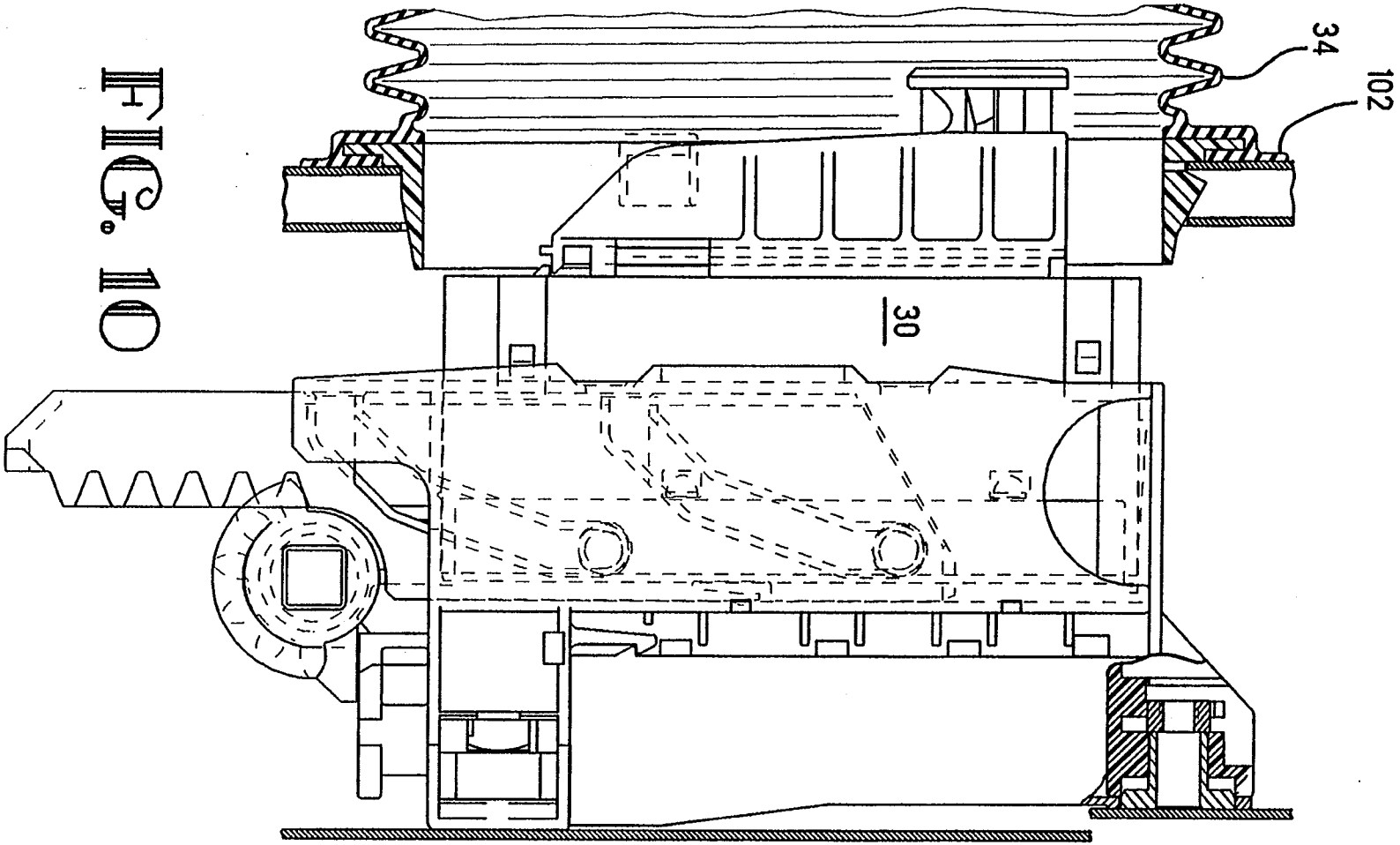
FIG. 10 is a view similar to that of FIG. 9 showing the connector assemblies in fully engaged position.
Figure 11:
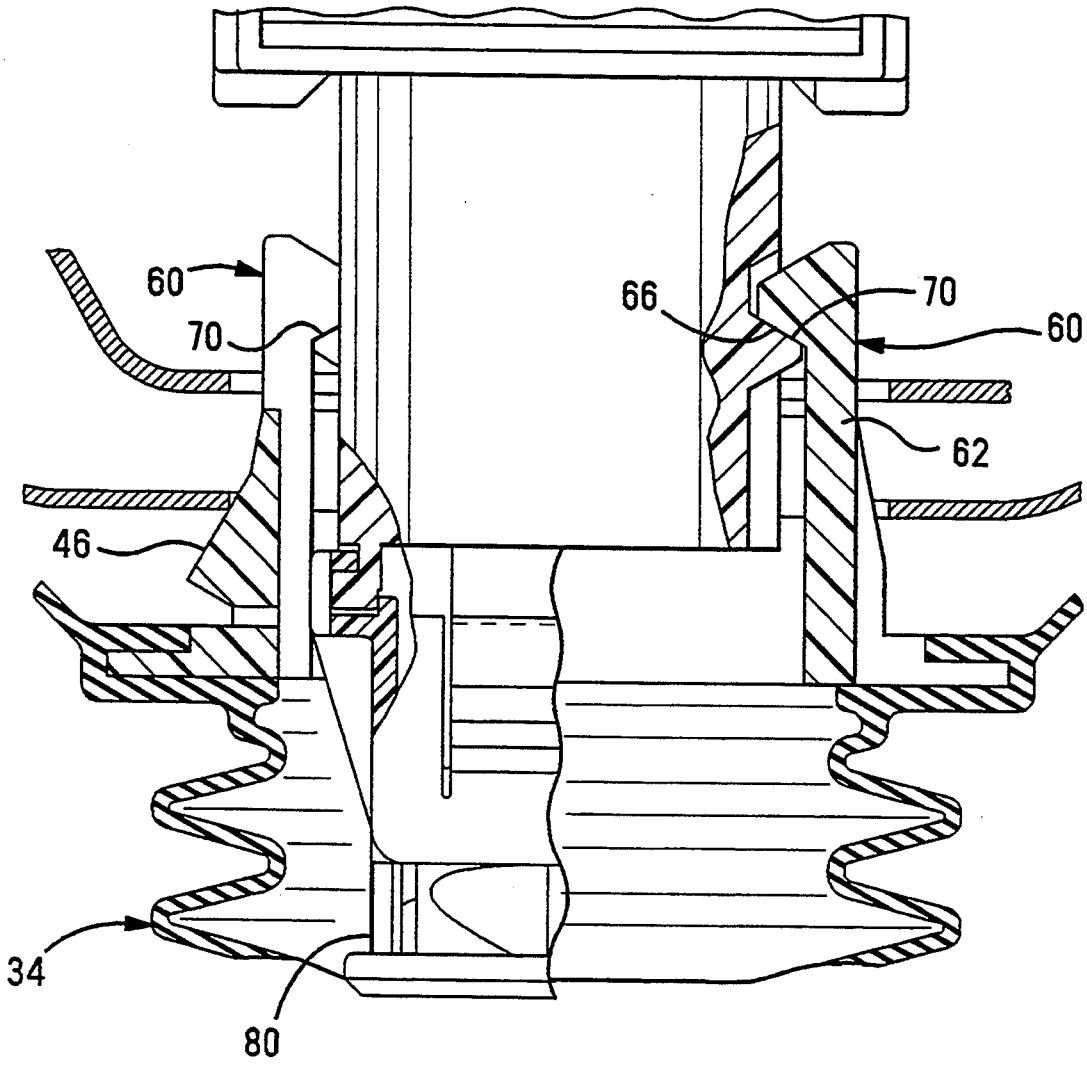
FIG. 11 shows the latching assembly between the shroud and the connector housing in greater detail.

With reference now to FIGS. 9–11, an alternate embodiment is shown which is identical to the embodiment of FIGS. 1–8, except for peripheral seal 100 formed directly with the boot portion 34. The seal 100 has a lip 102 which engages the wall 20*b* upon movement of the shroud 36 forwardly, as best shown in FIG. 10.

In either case, the assemblies as shown herein have overcome the problem existing in the prior art, that is, having to separately handle both the shroud portion as well as the connector portion. Rather, the shroud and connector portion can be assembled to the connector housing 6 independently, and actuation of the camming slide, seats the shroud 32 as well as fully mates the connector housing 30 with the mating component 6.

We claim:

1. An electrical connector assembly comprising first and second connectors, said first and second connectors having first and second complementary actuating members, respectively, for drawing the two connectors together, the second connector being insertable through a panel opening into engagement with the first connector, the second connector having a plurality of electrical terminals for engagement with mating contacts in the first connector, a housing being profiled for receipt through the opening and having the second complementary actuating member adjacent to a front of the housing for interaction with the first connector, the assembly being characterized in that the housing has a peripherally extending shroud that is latched therewith by latching members cooperable therebetween, the shroud having latches adapted to latch the shroud to the panel where the shroud remains exterior to the opening and adjacent to the panel, the actuating members causing the shroud and said housing to move into a final abutting position against the panel and latched thereto by the latches of the shroud; and wherein the latching members are profiled such that when the housing and the shroud are brought into latched engagement with the panel, continued activation of the actuating member causes the housing to break free of said latching members and continue forwardly into connection with the first connector.

2. The connector assembly of claim 1, characterized in that the shroud includes a peripheral seal facing the panel, and the actuating member moves the shroud and the seal into sealing engagement with said panel.

3. The connector assembly of claim 1, characterized in that an insulating boot extends from said shroud rearwardly, thereby sealing a cable connected to the terminals in the second connector.

4. The connector assembly of claim 3, characterized in that the seal and insulating boot are integrated into one piece.

5. The connector assembly of claim 1, characterized in that the latching members have a greater retaining force than the latches.

6. The connector assembly of claim 1, characterized in that the first actuating member comprises a U-shaped slide moveable transversely relative to the first connector, the U-shaped slide carrying camming slots having openings adjacent to forward edges thereof, which receive the second complementary actuating member on the housing.

7. The connector assembly of claim 6, wherein the second complementary actuating member on the housing is a lug which is receivable in the camming slot, whereby, transverse movement of the U-shaped slide moves the housing axially.

8. The connector assembly of claim 6, characterized in that the camming slot is separated into separate camming sections, a first section being relatively steep relative to a mating face of the first connector, providing quick movement of the shroud into a locked position, and a second camming section which is inclined less relative to the mating face of the first connector, whereby the mechanical advantage of the camming slot is increased to release the latching members, and to overcome the insertion force between the first and second connectors.

9. An electrical connector assembly comprising first and second connectors, said first and second connectors having first and second complementary actuating members respectively for drawing the two connectors together, the second connector being insertable through a panel opening into engagement with the first connector, the second connector having a plurality of electrical terminals for engagement with mating contacts in the first connector, a housing being profiled for receipt through the opening and having the second complementary actuating member adjacent to a front of the housing for interaction with the first connector, the assembly being characterized in that the housing has a peripherally extending shroud remaining exterior to the opening and adjacent to the panel, the housing and the shroud having first cooperating latches retaining them together, and the shroud has second latches profiled for engaging with the panel opening to retain the shroud to the panel, the latches being so profiled that a retaining force of the first latches retains the housing and the shroud together during activation of the complementary actuating members, until the second latches are latched to the panel, whereby continued activation of the actuating members causes the first latches to release the housing from the shroud, moving the housing independently into connection with the first connector.

10. The connector assembly of claim 9, characterized in that the shroud includes a peripheral seal facing the panel, and the actuating members move the shroud and the seal into sealing engagement with said panel.

11. The connector of claim 9, characterized in that an insulating boot extends from said shroud rearwardly, thereby sealing a cable connected to the terminals in the second connector.

12. The connector assembly of claim 9, characterized in that the first actuating member comprises a U-shaped slide moveable transversely relative to the first connector, the U-shaped slide carrying camming slots having openings adjacent to forward edges thereof, which receive the second complementary actuating member on the housing 16.

13. The connector assembly of claim 12, wherein the second complementary actuating member on the housing is a lug which is receivable in the camming slot, whereby, transverse movement of the U-shaped slide moves the housing axially.

14. The connector assembly of claim 9, characterized in that the camming slot is separated into separate camming sections, a first section being relatively steep relative to a mating face of the first connector, providing quick movement of the shroud into a locked position, and a second camming section which is inclined relative to the mating face of the first connector, whereby the mechanical advantage of the camming slot is increased to release the first latches, and to overcome the insertion force between the first and second connectors.

15. An electrical connector assembly for establishing an interconnection through an opening in a panel, said assembly comprising first and second connectors having complementary terminals and contacts therein and complementary actuating members for drawing the two connectors together, the second connector having a housing profiled for receipt through the opening to mate with the first connector and carrying a peripherally extending shroud therealong, the connector assembly being characterized in that actuation of the complementary actuating members causes the shroud to be brought into engagement with the panel, the two connectors to be mated and the shroud to break free of the housing.

16. The connector assembly of claim 15, characterized in that the housing and the shroud have latching members cooperable therebetween to carry the shroud upon the housing.

17. The connector assembly of claim 16, characterized in that the shroud and the panel have latches therebetween for engaging the shroud with the panel.

18. The connector assembly of claim 17, characterized in that the latching members between the shroud and the housing will break free in response to further actuation of the actuating members after the latches between the shroud and the panel are engaged.

19. The connector assembly of claim 15, characterized in that the shroud engages the panel and is broken from the housing before the first and second connectors are fully drawn together.

20. The assembly of claim 15, characterized in that the shroud carries a seal abutable with the panel and a boot in sealed communication with the seal that extends rearward from the shroud for sealing about a cable connected to the second connector.

* * * * *